US006648803B1

(12) United States Patent
Jay

(10) Patent No.: US 6,648,803 B1
(45) Date of Patent: Nov. 18, 2003

(54) STILTS

(76) Inventor: Jeffrey T. Jay, 4613 Charger Ave., North Las Vegas, NV (US) 89031-2117

( * ) Notice: Subject to any disclaimer, the term of this patent is extended or adjusted under 35 U.S.C. 154(b) by 0 days.

(21) Appl. No.: 10/065,339

(22) Filed: Oct. 4, 2002

Related U.S. Application Data

(60) Provisional application No. 60/327,370, filed on Oct. 4, 2001.

(51) Int. Cl.[7] ..... A63B 25/00; A61F 2/60
(52) U.S. Cl. ..... 482/76; 482/75; 623/28
(58) Field of Search ..... 482/75–76, 148; 623/28

(56) References Cited

U.S. PATENT DOCUMENTS 3,346,882 A * 10/1967 Wilhoyte ..... 623/28
3,902,199 A * 9/1975 Emmert ..... 623/28
4,570,926 A * 2/1986 Ensmenger ..... 482/75
4,927,137 A * 5/1990 Speer ..... 482/76
5,498,220 A * 3/1996 Ensmenger ..... 482/76
6,517,586 B2 * 2/2003 Lin ..... 623/28

* cited by examiner

*Primary Examiner*—Jerome W. Donnelly
*Assistant Examiner*—Fenn C Mathew
(74) *Attorney, Agent, or Firm*—Kenehan & Lambertsen, Ltd.; John C. Lambertsen

(57) ABSTRACT

A stilt having a multiple-articulating, three segment base provides enhanced stability and a better translation of walking forces. The intermediate base segment is attached to both toe and heel base segments in a manner that permits relative rotational movement between each segment. Providing an intermediate base segment having a length that is equal to or greater than the toe and heel base segments enables a more natural forward translation of walking forces, instead of requiring the heel to absorb most of the energy as in previous stilt designs.

1 Claim, 5 Drawing Sheets

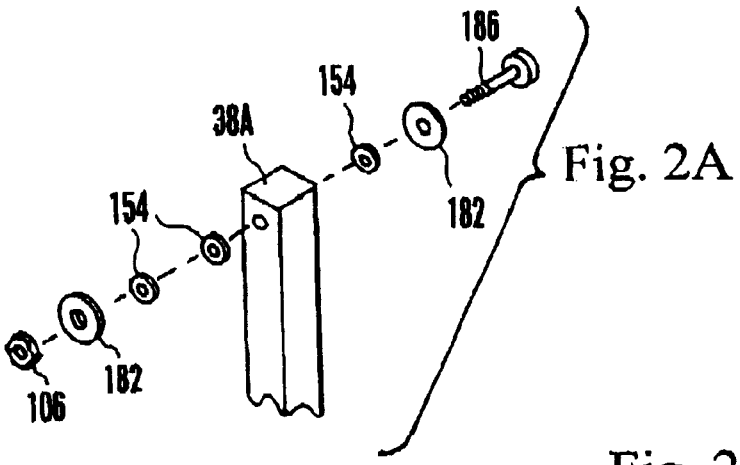
Fig. 2A
Fig. 2B
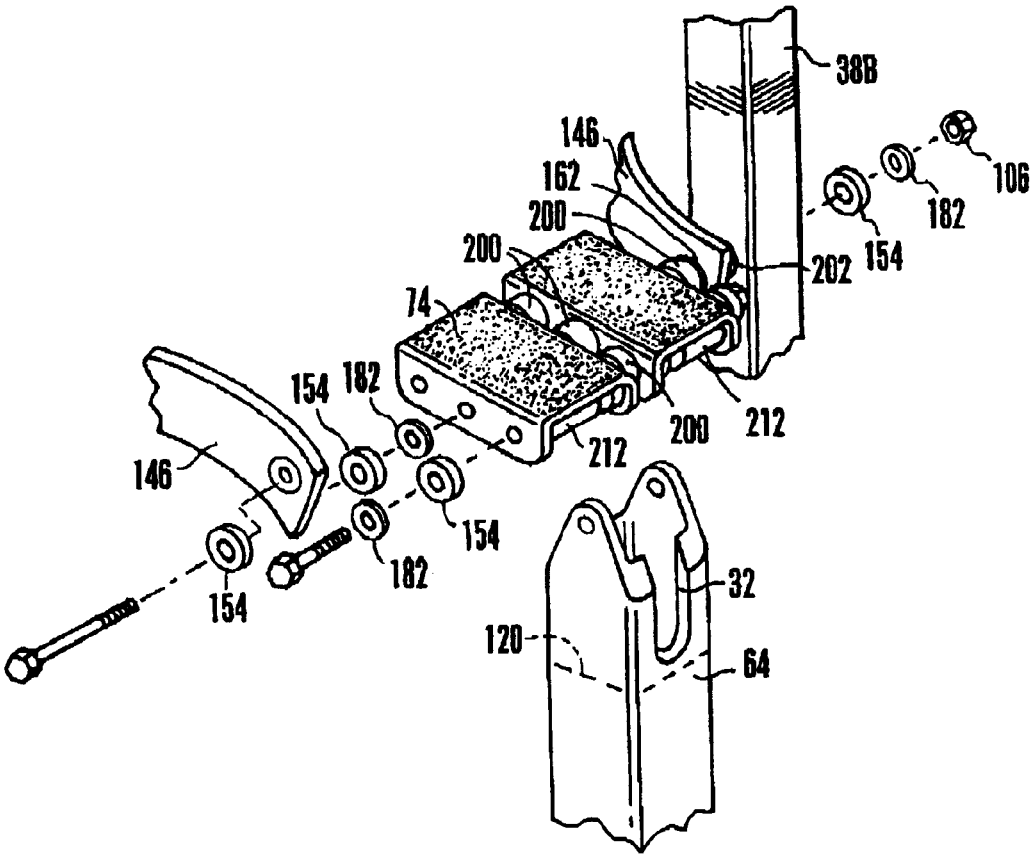

STILTS

CROSS REFERENCE TO RELATED APPLICATIONS

This application claims the benefit of U.S. Provisional Patent Application, Ser. No. 60/327,370, filed Oct. 4, 2001.

BACKGROUND OF THE INVENTION

1. Field of the Invention

The present invention relates to leg extension devices and, more particularly, to such devices as are removably attached to the legs of a user. More particularly, the present invention relates to a pair of stilts with articulating foot pads that provide enhanced maneuverability and stability to a user.

2. Description of the Prior Art

Recognizing physical limitations when compared to other animal life, mankind has longed to run faster, jump higher, and be taller than evolution has seemingly provided. Conceptually the latter appears the easiest to solve, using a pole extension to each leg. Such constructions are known as "peg" or "pole" (or sometimes "Chinese") stilts and they were of the earliest stilts designs.

Although simple in construction, users quickly appreciated the difference between a circumscribed, weight bearing surface and the human foot. Using pole stilts over the carefully prepared surfaces found in circuses is entirely different than attempting their use on gravel, on uneven surfaces, and where holes and like traps abound. Additionally, the lack of a stable base makes remaining stationary an exercise in balance, which is particularly a problem for those in construction, where their added height would be useful for ceiling and drywall installers.

An early attempt at providing stability envisioned the use of multiple supports, such as Hawk, U.S. Pat. No. 2,292,074, where four support feet are distributed under the foot support. The mobility issues of such a construction are readily apparent, and further efforts were required by stilts designers to better emulate the human foot.

A better attempt to simulate the stability and mobility provided by a human foot found its expression in the DURA-STILT® brand stilt design, the subject of U.S. Pat. Nos. 3,102,199 and 3,902,199 to Emmert. The early design provided a K-shaped support brace and two separate shoe plates identified as front and rear. The rear strut bore the majority of the load, with two diagonal pieces forming a forward lever that is attached to the rear strut at an intermediate location in a two-spring housing that permitted vertical movement within the rear strut.

The K-shaped support lever with the spring connection attempted to mimic the shifts in weight between the front and back of a human foot during various forms of locomotion. In a later improvement (U.S. Pat. No. 3,902,199), the forward K-brace was straightened into a front strut, and the spring mounting moved outside of the rear strut, to a location between the two struts. With a foot plate above and two base pads below, the hinged struts form a parallelogram simulation of human foot movement.

Although two base pads were in use, with a rigid footplate the base pads function as a substantially single rigid structure. Stilt walking using such a construction was in many ways similar to walking in a pair of oversized boots. Additionally, the spring mechanism added weight to the stilts, making it more difficult to execute fine movements or even remain in the stilts for long periods of time.

Articulation of both the footpad and the base pads considerably simplifies the stilts structure, as is taught by Ensmenger in U.S. Pat. No. 4,570,926. Known as the BIGFOOT™ stilts, three support columns connect the foot holder and the base at hinged connections. In a departure from previous stilt designs, the base and the foot holder are divided into a "toe" portion and a "heel" portion by a hinge.

The three hinged columns thus define a pair of parallelograms, with the central column shared. Such a design provides stability to the wearer, whether the weight is evenly balanced between toe and heel, or where a particular movement results in a weight shift to either the heel or toe.

By providing this lightweight design, it was contemplated that such stilts would permit complex, controlled movements that were previously not possible using the prior designs. Such movements inherently subject the wearer to side loads, and to provide stability to resist such loadings, a calf brace is provided. To avoid requiring the user to over tighten the attachment strapping, a V-shaped bracing is used, with the leg of the user received within the upper portion of the "V".

In the 926 Ensmenger Patent, the rear heel column is a double column that is joined at the bottom and angles outwardly to a pair of opposed attachment points along the outer edge of heel. The double column extends above these hinged attachments to form the calf brace. Unfortunately, this angled, two-piece construction with its side attachments pointing to the foot holder does not provide the strength of a single column heel brace. This vulnerability is particularly important during maneuvers on stilts that create particularly violent impact loadings on the heel portion, such as when landing after jumps.

This design shortcoming was addressed in the second Ensmenger Patent, No. 5,498,220, where the double-column heel support base attachment location is moved from the heel base to a horizontal support beam. A single column is then used to connect the heel base and the heel holder. The support beam extends from the single column heel to the middle, sole column, with hinges at both connections to permit its pivoting along with the heel base. In this manner a sound calf attachment is provided that helps to firmly attach the stilt walker to the stilts, yet the split brace is no longer a vertical load-bearing structure.

As was noted by Ensmenger, a toe-articulated stilt was considerably more natural in use than either the pole stilt or even the solid linear base of the DURA-STILT®. However, just as certain styles of military marching where great force is applied to the heels resulted in heel and back problems, acrobatics and dance routines place great forces on the heels of stilt walkers. A need exists to modify the present stilts design to enable the stilts to absorb much of the vertical impact, and thereby assist in shifting the majority of such forces away from the heel.

SUMMARY OF THE INVENTION

It is an object of the present invention to provide a stilt having a multiple-articulating base. In this regard, an intermediate base segment is attached to both a toe and a heel segment in a manner that permits relative rotational movement between each segment. The length of the intermediate base segment is substantially equal to or greater than the length of either the heel or the toe segments, and by permitting the heel base to rotate relative to the intermediate base segment, walking forces are translated through the stilt base in a more natural manner.

It is a further object of the present invention to connect the multiple base segments of said stilt to a foot support or shoe utilizing a plurality of struts. In this regard a pair of front struts and a pair of rear struts are attached to the toe segment and the heel segment, respectively. A pair of strut braces is attached to each forward and rearward strut pair, providing lateral support, preventing lateral movement of the support struts. The strut braces are attached in a manner permitting relative angular movement between the struts and the strut braces. In this manner movement of the toe segment or the heel segment of the shoe is reflected in a like movement in the toe base or heel base.

A still further object of the present invention is to provide a stilt walker with enhanced lateral stability utilizing a securely anchored calf band. In this regard, a pair of support braces is attached to the rear struts and strut braces, as well as to the heel segment of the shoe. By such attachment at multiple lateral locations, side loadings placed on the calf band are vertically distributed over a number of individual members of the stilt.

Some further objects and advantages of the present invention shall become apparent from the ensuing description and as illustrated in the accompanying drawings.

BRIEF DESCRIPTION OF DRAWINGS

FIG. 2A is a partial exploded side perspective view showing further details regarding fasteners used at an upper end of a support brace in accordance with the present invention;

FIG. 2B is a partial exploded side perspective view showing additional details regarding a manner of fastening a heel segment to a rear heel strut and support brace in accordance with the present invention;

DETAILED DESCRIPTION

Figure 1:
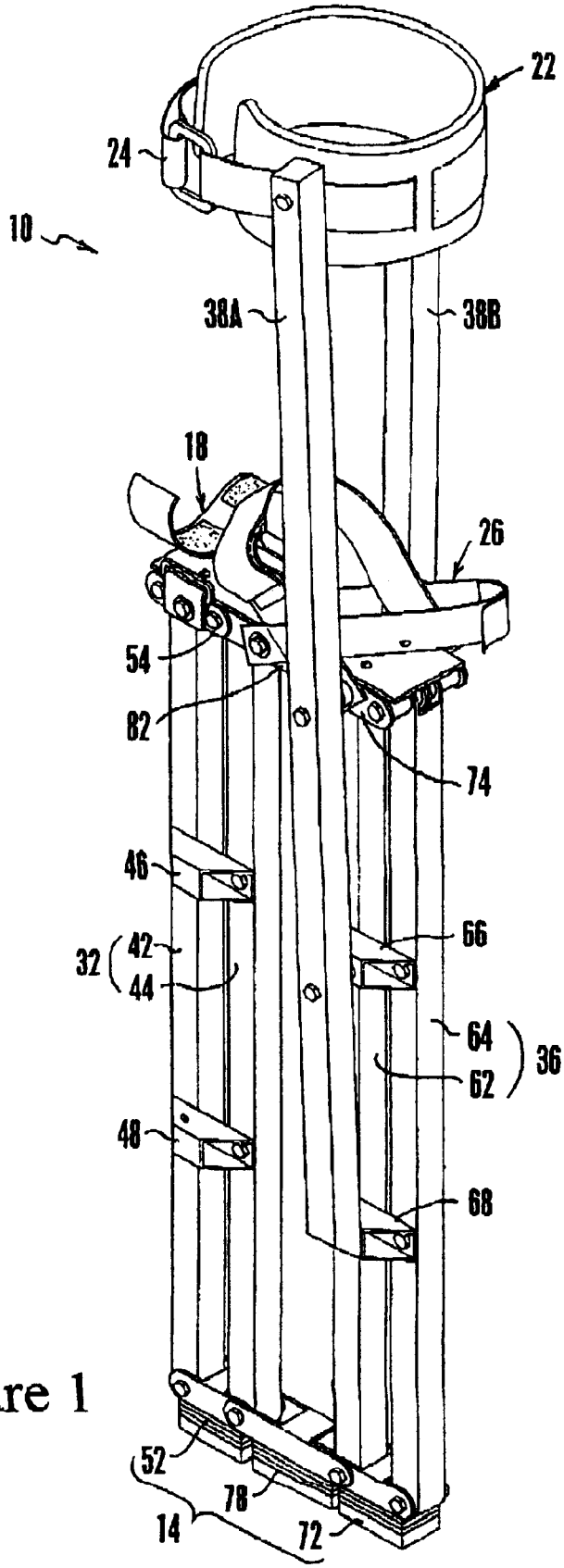
FIG. 1 is a side perspective view showing a stilt in accordance with the present invention.

Reference is now made to the drawings wherein like numerals refer to like parts throughout. A stilt 10 is shown in FIG. 1, having a base 14 extending from a shoe 18, with a removable calf pad 22 positioned thereabove. The collar brace is provided with a conventional calf band and buckle fastener 24 to assist in holding the stilt walker in position within the stilt 10. In a similar manner, the shoe 18 includes restraining straps 26 to maintain a users foot (not shown) in proper position on the shoe 18.

The base 14 is attached to the shoe 18 by a pair of front struts 32 and a pair of rear struts 36. A pair of support braces 38A, 38B is attached to opposing lateral sides of the calf band 24, and extend down to an attachment location on the rear pair of struts 36.

The pair of front struts 32 consists of a front toe strut 42 and a rear toe strut 44. To provide lateral support to the front struts 32, they are attached to one another at two places between the base 14 and the shoe 18. An upper front strut brace 46 and a lower front strut brace 48 are each separately attached to both the front toe strut 42 and the rear toe strut 44, preferably at evenly spaced locations between the base 14 and the shoe 18.

For both the base 14 and the shoe 18, the points of attachment with the front toe strut 42 and the rear toe strut 44 define a toe base 52 and a toe segment 54. Each of these individual segments may be articulated relative to the remaining portion of the base 14 and the shoe 18. To further assist in such articulation, the upper front strut brace 46 and the lower front strut brace 48 are attached to their respective front struts 32 in a pivotable manner, permitting relative angular movement between each of the front struts and the strut braces.

As so connected, each of the pair of front struts 32 can move vertically relative to one another, while the upper and lower strut braces 46, 48 restrict unwanted (and unsafe) lateral movement (buckling) of these load-bearing structures. In this manner movement of the toe segment 54 is reflected in the toe base 52, enabling the stilt walker (not shown in FIG. 1) to manipulate the toe base 52 as required to accomplish desired stilt movement(s).

In a similar fashion, the pair of rear struts 36 consists of a front heel strut 62 and a rear heel strut 64. An upper rear strut brace 66 and a lower rear strut brace 68 attach the rear struts 36 at vertical locations along the rear struts 36 that correspond to the upper and lower front strut braces 46, 48. The points of attachment for the pair of rear struts 36 likewise define a heel base 72 and a heel segment 74 in the base 14 and the shoe 18, respectively.

The toe base 52 and the heel base 72 together define an intermediate base segment 78 formed in the base 18 that lays therebetween. The intermediate base segment 78 is attached to its adjacent segments in a pivotal manner, permitting a three-segment articulation in the base 18. Similarly it is with the shoe 18, where the toe segment 54 and the heel segment 74 define an intermediate shoe segment 82 that is likewise pivotally connected to its adjacent segments of the shoe 18 to obtain a like articulating movement when required.

As previously mentioned, one of the initial fears of a would-be stilt walker is the fear of falling. It is therefore important to securely anchor the stilt walker within the stilts 10. The calf band 24 provides a large part of such security, and it is crucial that the calf band 24 be securely anchored. In addition to its attachment to the lower rear strut brace 68, each of the support braces 38A, 38B are also attached to the upper rear strut brace 66 and to the shoe 18. In this manner, the side loading that is placed on the calf band 24 during use of the stilt 10 is vertically distributed over a number of individual members of the stilt 10.

As with many other highly stressed structures, the construction of a stilt involves design-balancing strength and weight. If it is to be useful to a stilt walker, the overall design must be sufficiently light in weight as to permit its use in complex dance and acrobatic routines. So too, the resulting construction must be able to withstand the many multiple impact and side loadings as will occur during these activities.

Figure 2:
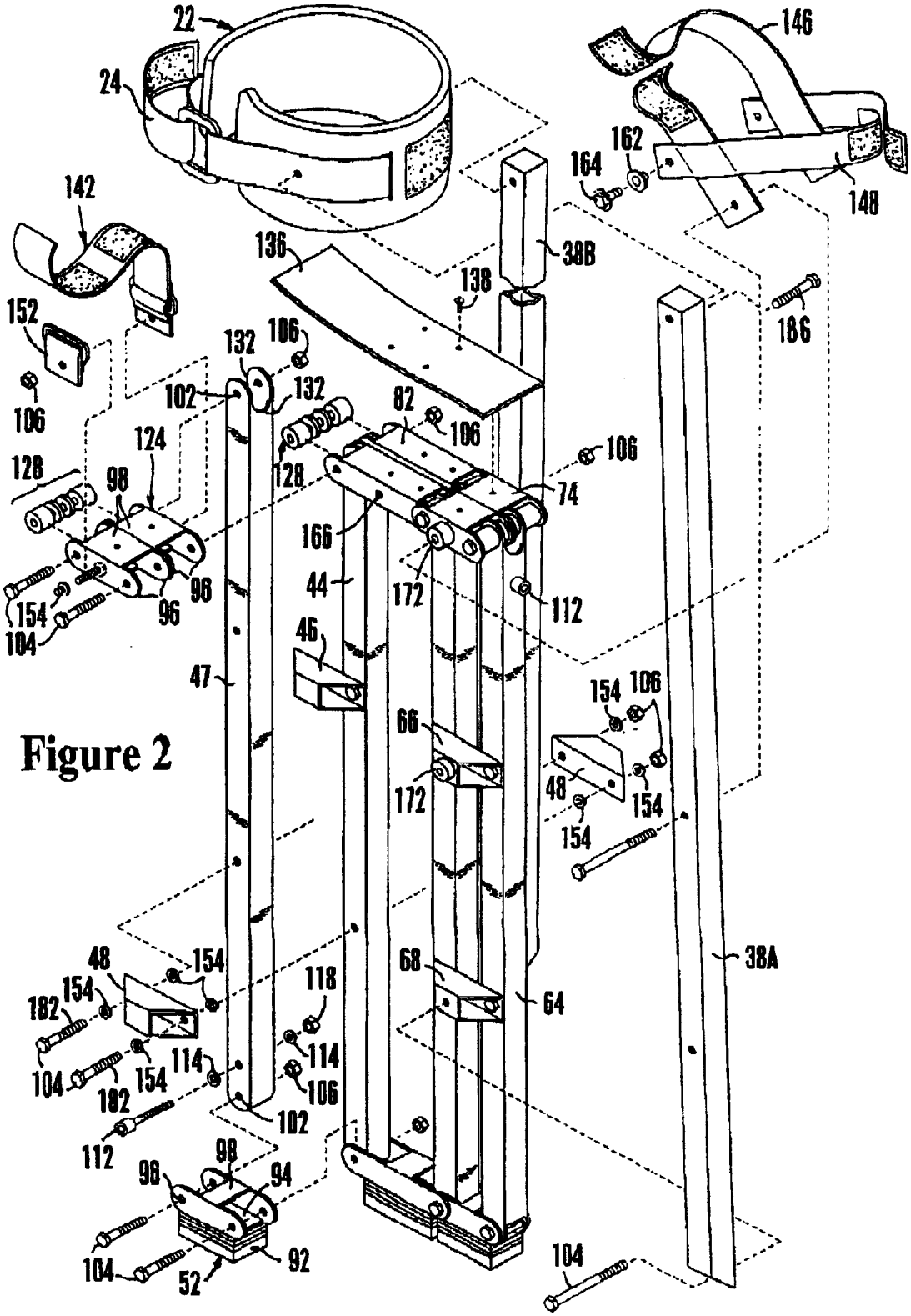
FIG. 2 is an exploded side perspective view, similar to FIG. 1, showing the various component parts of a stilt in accordance with the present invention.

The manner of construction for the stilt 10 of the present invention is best discussed in the context of FIG. 2. Turning first to the attachment of a base member to an individual vertical member, in FIG. 2 such is typified by the attachment of the toe base 52 to the front toe strut 42. The toe base 52 consists of a resilient pad 92 that is attached to a support frame 94. Structure in the manner of an open box frame, the support frame 94 includes a pair of outer flanges 96 separated by, and attached along their top and bottom edges to, a pair of cross members 98.

The outer flanges 96 laterally terminate in rounded edges to avoid interference as the base segments pivot relative to one another, and an aperture is located at the radius of each such rounded end. These rounded ends of the outer flanges 96 are received by opposed outer surfaces of the lower end of the front toe strut 42.

An attachment aperture 102 is formed at an appropriate location in the lower end of the front toe strut 42, and upon alignment of the apertures formed in the outer flanges 96 and the attachment aperture 102, a threaded bolt 104 is received therein and is secured by a nut 106 (preferably Nyloc). In a preferred embodiment Teflon® washers are placed between the outer flanges 96 and the outer surfaces of the toe strut 42 to permit pivoting movement of the toe strut 42 relative to the toe base 52 as was previously discussed.

The front toe strut 42 and the other struts that make up the supporting structure for the stilt 10 are designed to accommodate a great deal of vertical loading forces. A safety pin is provided inward of the attachment locations at the base 14 and the shoe 18 to further protect against structural failure.

In FIG. 2 an Alan head or socket head bolt 112 is shown received at the lower end of the front toe strut 42 just above the connection with the toe base 52. A metal washer 114 is received on either side of the front toe strut 42, and the socket head bolt 112 is secured by a Nyloc® nut 118. The socket head bolt 112 secures an acetyl-backing segment 120 (see FIG. 2B) placed within the terminus of the front toe strut 42 (shown within the rear heel strut 64 in FIG. 2B). This backing-system considerably reduces the likelihood of strut failure at the connection with the toe base 52.

The connection between the shoe 18 and the struts is subject to even greater loading problems, and will be discussed in FIG. 2 in the context of the connection between the front toe strut 42 and the toe segment 54. To enable adequate support to a users foot (not shown in FIG. 2), each of the individual segments of the shoe 18 make use of an enlarged support frame 124, that is essentially two of the support frames 94 used in the base 14 laid side-by-side. As so arranged, there are four outer flanges 96, with the middle two doubled-up to provide significant additional mechanical strength to the enlarged support frame 124.

In a manner similar to that in the support frame 94 used in the base 14, apertures are provided in the outer flanges 96 for receiving a threaded bolt 104. Further strengthening is obtained by utilizing a plurality of spacers and washers 128 that are located between the adjacent outer flanges 96 and received by the threaded bolt 104.

An attachment aperture 102 is formed in the upper end of the front toe strut 42 to receive the most forward threaded bolt 104 and thereby attach the enlarged support frame 124 to the front toe strut 42. The rearward threaded bolt 104 is received in an attachment aperture (not shown) formed in the rear toe strut 44. This same threaded bolt 104 is also received within the apertures formed in the outer flanges 96 of the intermediate shoe segment 82, thereby attaching it to the rear toe strut 44 as well. A pair of nuts 106 (preferably Nyloc) are received on the threaded bolts 104 to complete these connections.

The inner pair of outer flanges 96 of the enlarged support frame 124 extends below the attachment aperture, and thus lateral recesses 132 are formed in the upper end of the front toe strut 42. In an effort to prevent the formation of stress fractures, in a preferred embodiment the lateral recesses 132 are filleted or rounded in form, as are the corresponding apertures formed in the acetyl backing piece 120 (shown in the context of the rear heel strut 64 in FIG. 2B) that is fitted within the support frame to provide further structural integrity at these attachment locations.

The remaining segments of the shoe 18 are similarly constructed and attached to the remaining struts in the same manner. Once completed, a foot pad 136 is attached to the top surfaces of the enlarged support frames that together form the shoe 18 using a plurality of retaining fasteners 138 (only one shown in FIG. 2). Alternatively, the foot pad 136 is not used and a non-slip surface is formed directly on the metal components forming the foot-receiving surface.

In addition to the footpad 136 (optional, as discussed above), the shoe 18 consists of a front harness 142, an instep harness 146, and a heel harness 148. Constructed in a conventional manner, using hook and loop fasteners as well as buckles, it is important that these "consumables" are easily replaced when they become warn. This is conveniently accomplished by attaching a bolt head and flat washer to an inside surface of an outer flange in the appropriately located shoe segment, in FIG. 2 this is best shown on the enlarged support frame 124 that makes up the toe segment 54.

The remaining portion of the threaded bolt projects outwardly, away from the enlarged support frame 124, through an aperture formed in the outer flange 96. A harness clip 152 is received upon the projecting bolt, which is then secured by placement of a Teflon® washer and nut 106 (preferably Nyloc). The remaining portion of the front harness 142 is secured to the other side of the enlarged support frame 124 in a similar manner.

The instep and heel harnesses 146, 148 are attached to the intermediate shoe segment 82 and the heel segment 74 in a slightly different manner due, in part, to the co-attachment of the support braces 38A, 38B to the heel segment 74 as well. A plurality of grommets 162 is placed in each of the harness apertures to strengthen the harness at the points of attachment. The forward attachment of the instep harness 146 to the intermediate shoe segment 82 utilizes a harness bolt 164 that is received within a harness aperture 166 formed in an outer flange of the intermediate shoe segment 82. These various connections are shown in greater detail in FIG. 2B which also illustrates a variation in the depth of the lateral recess 132 to lessen the opportunity for impact of the rear heel strut 64.

A similar aperture is formed midway along the length of the heel segment 74; however this aperture is also the location of attachment for the support brace 38A to the shoe 18. A support brace spacer 172 is placed between the harness strip and the support brace 38A, with a brace retaining bolt 174 received by an aperture formed in the support brace 38A and extending through the support brace spacer 172, the reinforcing grommet 162, and then through the heel segment 74 to be secured by nut 106 (preferably Nyloc).

The remaining attachment points for the support braces 38A, 38B are the strut braces 66, 68. In FIG. 2, their attachment to the vertical struts is best described in the context of the attachment of the lower front strut brace 48 to the front toe strut 42 and rear toe strut 44. As may be recalled, the braces and struts pivot with respect to one another, and thus the manner of attachment must permit pivoting motion yet restrain any tendency of the struts to twist or move laterally.

A pair of lower front strut braces 48 is received on opposing lateral sides of the front toe strut 42 and the rear toe strut 44. A pair of apertures formed at each end of the strut braces is aligned with apertures formed in each of the struts. To permit pivotal movement, a plurality of Teflon® washers 154 are used, their placement is between both the braces and the struts, as well as between the braces and the bolt securement fastener. In regard to the latter, a flat washer 182 is placed between the Teflon® washer 154 and the heads of the bolts 104 and the Teflon® washers 154 and the nuts 106 (preferably Nyloc).

With the remaining braces attached to the strut pairs in a similar manner, the support braces 38A, 38B can then be attached to both the upper rear strut brace 66 and the lower rear strut brace 68. At the base of the support brace 38A the attachment to the lower rear strut brace 68 is preferably accomplished using a conventional threaded bolt 104 received by a sequence of aligned apertures in the brace and strut, and on the opposite side, a corresponding aperture formed in the second support brace 38B. A nut (not shown) completes the connection.

On the upper rear strut brace 66, much like was the case with its attachment to the shoe 18, it is important that the support braces 38A, 38B angle outwardly, to accommodate the users leg (not shown in FIG. 2). Thus, as was discussed previously, support brace spacers 172 are used between the outer surface of the upper rear strut brace 66 and the inner surfaces of the support braces 38A, 38B. A pair of threaded fasteners 186 (only one shown in FIG. 2) then complete the attachment of the calf band 24 to each of the support braces 38A, 38B. Additional details of this connection are shown in FIG. 2A.

Figure 3:
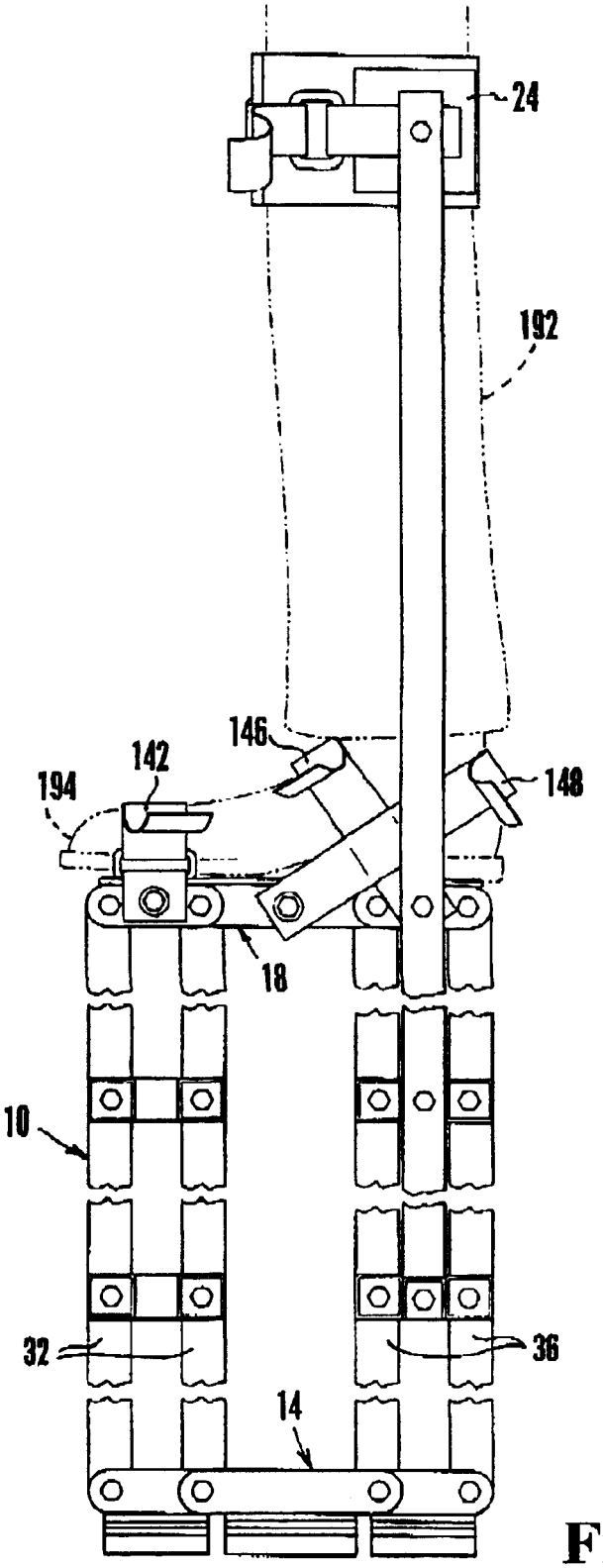
FIG. 3 is a partial side elevation view, with portions in phantom, showing the manner of use of a stilt in accordance with the present invention.

In FIG. 3 a leg 192 of a stilt walker (shown in phantom) is depicted as received within the stilt 10. A foot 194 of the user is shown placed on the shoe 18, with the front harness 142 and the instep and heel harnesses 146, 148 tightly holding the foot 194 in position. With the foot 194 flatly placed upon the shoe 18 as is depicted in FIG. 3, there is no "lifting" force being applied to either of the front struts 32 or of the rear struts 36, and consequently the base 14 lies flat against the surface upon which it rests.

Figure 4:
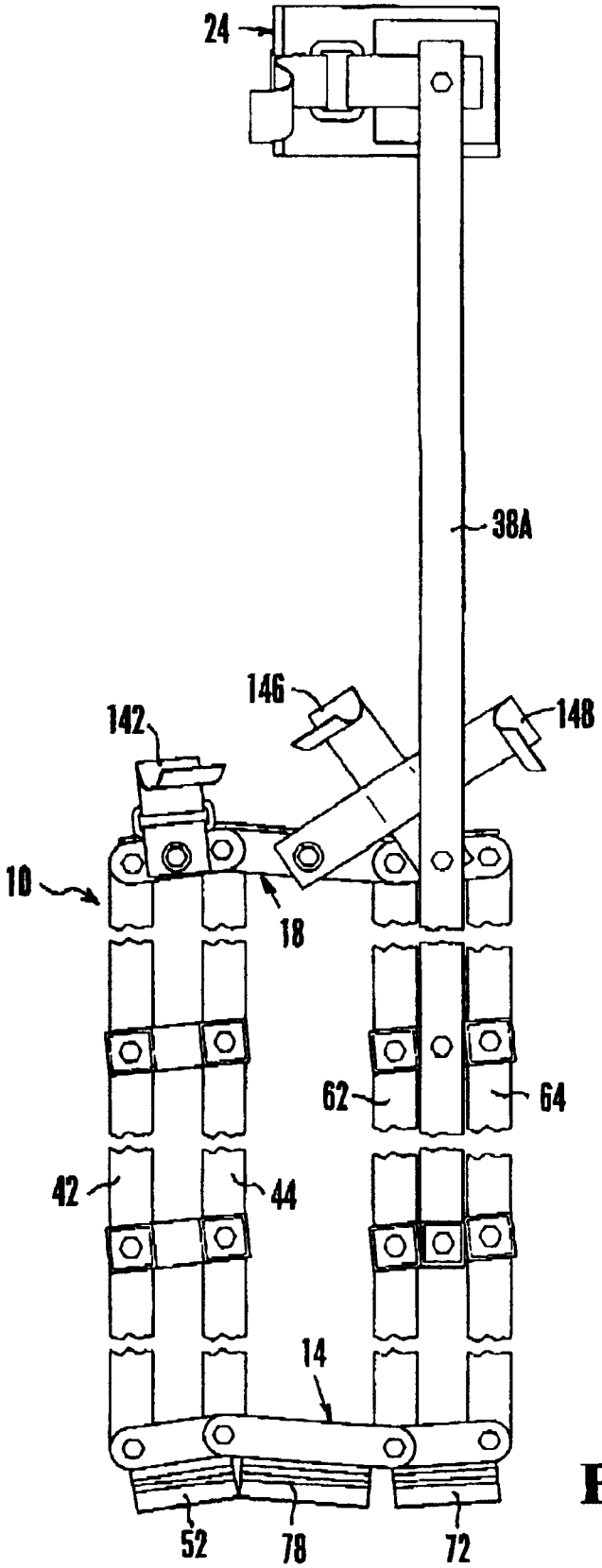
FIG. 4 is a partial side elevation view, similar to FIG. 3, showing the manner of articulation of multiple footplates in accordance with the present invention.

In FIG. 4 the stilt 10 is shown where there is a relative upward force being applied to the rear toe strut 44 and the rear heel strut 64. The differences in forces applied to the base 14 through the multiple struts cause an articulation among the multiple segments making up the base 14. In the example depicted in FIG. 4, the toe base 52 has rotated counterclockwise from the horizontal while the intermediate base segment 78 has rotated in a clockwise manner. The heel base 72 has also rotated from the horizontal in a counterclockwise manner; however, under the example depicted in FIG. 4, this rotation has been to a lesser extent than that of the toe base 52.

The ability of the base 14 to multi-articulate results in considerable benefits to the stilt walker. For humans, the forces associated with walking initialize at the heel and move forward. The traditional stilt design interferes with the normal translation of these forces, requiring the stilt walker to absorb many of these forces in his or her legs. Fatigue is the result, shortening stilt performance times. By permitting the heel base 72 to rotate relative to the intermediate base segment 78, these walking forces are permitted to translate forward through the base in a more natural manner, diminishing the stress that has previously been applied to the legs of the stilt walker.

The articulation of the heel base 72 and the intermediate base segment 78 also assists the stilt walker recover from heel strikes. In previous stilt base designs, clipping a heel on a curb, elevated ridge, etc., translated forces immediately to the legs invariably resulting in the stilt walker buckling at the knees and falling. By providing an intermediate base segment 78, these forces are first translated through this segment, and into the toe base 52 all of which provides additional time for the stilt walker to recover his or her balance otherwise than just in the legs.

In a presently preferred embodiment, the stilt 10 is fabricated out of a number of different materials, with an overall design emphasis on weight reduction but with strength and durability. The front and rear struts are preferably fabricated out of aircraft aluminum, using an extrusion process. The strut braces likewise are made out of aircraft aluminum, and the fasteners used for attachment are preferably steel (Grade 8).

The metal in the support frames used to construct the base and shoe is preferably aircraft aluminum, and the resilient pads on the base are tire tread or high density rubber material. The collar brace can be of conventional laminated foam, and the footpad is conveniently formed out of a non-skid material, with leather optional. Military-spec Nylon webbing with security buckles and hook and loop fasteners are satisfactory for use in the holding straps for the shoe.

A typical height for a pair of stilts to be used in dance, acrobatics, parades, and other public performance arenas is 18 inches to 42 inches. This requires each of the struts to similarly vary in length, all preferably of square cross-section, measuring 1 inch by 1 inch. When fabricated out of 2024 or 7075 aircraft aluminum alloys, a satisfactory thickness in terms of both strength and weight is 0.05 inches. The strut braces are fabricated out of these same aircraft aluminum alloys of thickness 0.05 inches, measuring 3¼ inches by 1 inch at their base and 1½ inches by 1 inch at their exposed, outer surface.

The shoe for such a stilt has an overall base measuring 3¼ inches in width and 11¼ inches in length. The individual segments for the base include 1½ inches by 3¼ inches for the toe base, 1½ inches by 6¾ inches for the intermediate base segment, and 1½ inches by 3¼ inches for the heel base. If there is to be a variance in the base length, it is preferred that the variation be localized in the length of the intermediate base segment. The resilient pad used in each of the base segments is initially of thickness 15/16-inches to 1 inch. The support frame for the segments is optimally fabricated out of these same aircraft aluminum alloys of 0.80 inches in thickness.

My invention has been disclosed in terms of a preferred embodiment thereof, which provides an improved stilt that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. A stilt comprising:

a base that comprises in substantially linear arrangement:
a toe base segment,
an intermediate base segment, and
a heel base segment, said intermediate base segment rotationally attached to said toe base segment and said heel base segment and extending a length therebetween of substantially equal or greater distance than an extending length of either of the adjacent base segments, a pair of struts rotationally attached to and extending from each of said base segments;

a shoe rotationally attached to and supported by said plurality of struts, said shoe comprising in substantially linear arrangement:

a toe shoe segment, an intermediate shoe segment, and a heel shoe segment, said intermediate shoe segment rotationally attached to said toe shoe segment and said heel shoe segment, and extending a length therebetween of a substantially equal or greater distance than an extending length of the adjacent heel shoe segment, wherein a first pair of struts are attached to said toe base and said toe shoe segments, a second pair of struts are attached to said intermediate base and said intermediate shoe segment, and a third pair of struts are attached to said heel base and said heel shoe segments;

a plurality of strut braces, each rotationally attached to and extending between one of said pair of struts, wherein each of said pair of struts have at least two opposed pairs of strut braces attached thereto;

a pair of lateral support bracing attached to said third pair of struts and extending beyond said shoe, said pair of lateral support bracing attached to said third pair of struts at said locations of attachment for said strut braces and at said heel shoe segment;

a calf restraining strap attached to said pair of lateral support bracing adjacent an extended terminus thereof; and a harness attached to said shoe, said harness configurable for selectively retaining a foot of a user against said shoe.

* * * * *